US005870064A

United States Patent [19]

Kaegebein

[11] Patent Number: 5,870,064

[45] Date of Patent: Feb. 9, 1999

[54] SIGNAL TRANSMISSION ANTENNA MAST

[75] Inventor: Daniel P. Kaegebein, Depew, N.Y.

[73] Assignee: TX RX Systems Inc., Angola, N.Y.

[21] Appl. No.: 941,844

[22] Filed: Oct. 1, 1997

[51] Int. Cl.[6] ..... H01Q 21/00; H01Q 1/00

[52] U.S. Cl. ..... 343/853; 343/791; 343/905; 333/1; 174/28

[58] Field of Search ..... 343/853, 890, 343/891, 790, 791, 874, 875, 905; 333/244, 245, 237; 174/28, 29, 126.1, 126.3, 128.1, 128.3; 439/578

[56] References Cited

U.S. PATENT DOCUMENTS

| | | | |
|---|---|---|---|
| 2,510,358 | 9/1950 | Wolf | 156/47 |
| 2,521,550 | 9/1950 | Smith | 343/905 |
| 4,315,098 | 2/1982 | Dougherty | 174/155 |
| 4,745,412 | 5/1988 | Creaser, Jr. | 343/890 |
| 4,847,443 | 7/1989 | Basconi | 174/32 |

*Primary Examiner*—Hoanganh Le
*Assistant Examiner*—Tan Ho
*Attorney, Agent, or Firm*—R. Craig Kauffman

[57] ABSTRACT

A ridged coaxial transmission line assembly including a plurality of parallel transmission paths is fabricated from an extrusion incorporating a plurality of slotted, longitudinal bores provided with centrally located conductors held in position by insulating stand-offs provides a structure performing the dual functions of electrically integral antenna mast and signal conductors for a linear array of antenna elements supported by the mast.

10 Claims, 2 Drawing Sheets

SIGNAL TRANSMISSION ANTENNA MAST

FIELD OF THE INVENTION

This invention relates to ridged coaxial transmission lines including a plurality of parallel transmission paths and antenna masts fabricated there from.

BACKGROUND OF THE INVENTION

Historically vertical, linear array antennas have been unnecessarily bulky and require a relatively massive mast to support the plurality of transmission lines and power dividers. The devices are generally untidy and mechanical configuration due to the assemblage of bundled transmission lines leading to power leakages. Furthermore, such configurations increase the diameter of the overall assembly requiring larger radomes causing the devices to be more susceptible to high winds, resulting in a requirement for even more massive antenna masts.

OBJECTIVES OF THE INVENTION

A primary objective of the invention is to provide an antenna mast assembly comprised of a plurality of parallel coaxial transmission lines.

Another objective of the invention is to provide a rigid assembly comprised of a plurality of parallel coaxial transmission lines.

In view of the problems exhibited by prior art antenna masts used in vertical linear arrays of antennas, it is a primary objective of the present invention to provide an electrically integral antenna mast for linear array antennas which integrates transmission lines with the physical structure of the antenna mast to thereby reduce the materials required and simplify construction.

SUMMARY OF THE INVENTION

An antenna mast for a linear array of antenna elements is fabricated from an electrically conductive extrusion incorporating a plurality of circular, longitudinally slotted bores running the length of the antenna mast combined with a plurality of conductors arranged within the bores and supported centrally therein by non-conductive means to create coaxial transmission lines integral with the antenna mast.

DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1:
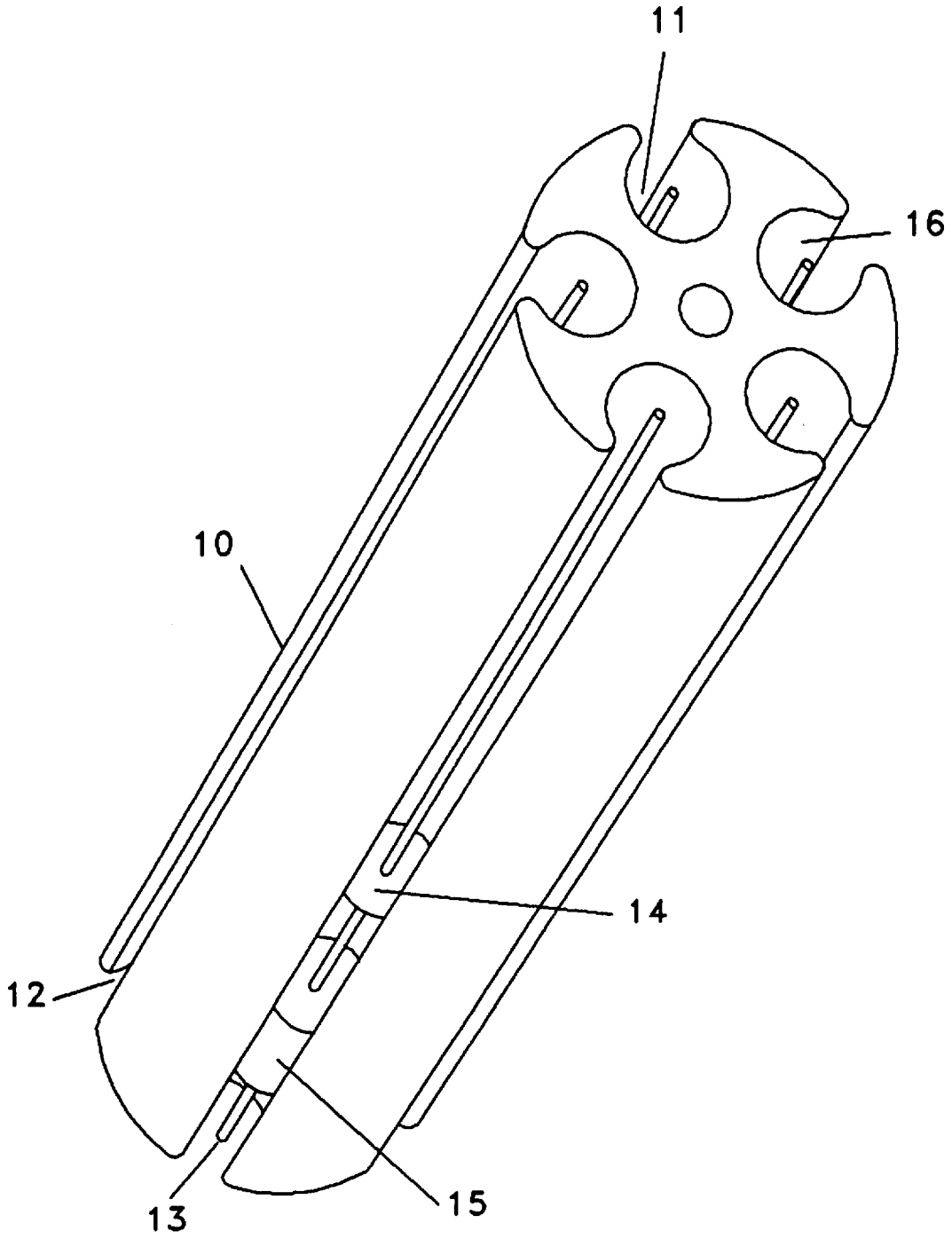
FIG. 1 is a perspective view of an antenna mast constructed according to the teachings of the present invention.

FIG. 1 illustrates a section of the antenna mast of the invention. The structural portion of the mast 10 is an aluminum extrusion in a preferred embodiment but it may be an extrusion of any desired electrically conductive material. A plurality of bores 11 are equally spaced around the perimeter and include longitudinal slots 12 which are provided to simplify assembly of the conductors 13. Insulating spacers 14 hold the conductors centrally in their respective bores, creating coaxial transmission lines. The conductive superstructure 10 of the mast functions as the outer conductor for each coaxial transmission line assembly and the impedance is set by properties of the conductors.

Non-conductive, dielectric loading means, such as Teflon sleeve 15, may be used to alter the electrical characteristics of the coaxial transmission lines and thereby provide selective phase shifts for antenna arrays supported and driven via the mast 10.

In an alternate application, phase shifts between elements of an antenna array may be provided by varying the length of selected coaxial transmission lines to thereby vary the distance between antenna elements of an array.

In the preferred embodiment, the mast 10 is an aluminum extrusion but other metals are contemplated. In an alternative embodiment, the extrusion may be non-conductive with an electrically conductive plating 16 coating the surfaces and forming the outer conductors of the coaxial subassemblies.

Figure 2:
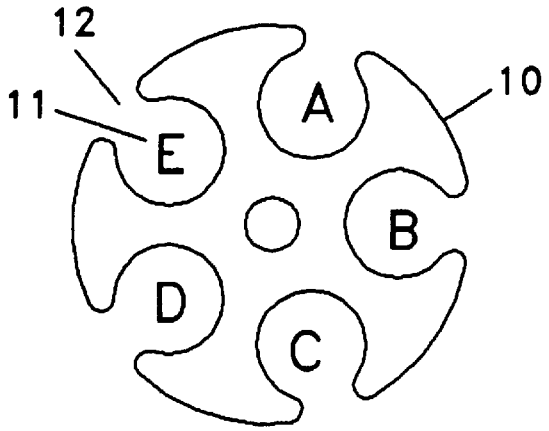
FIG. 2 is a cross sectional view of a preferred form of the invention.

The best mode of the invention is an aluminum extrusion incorporating bores equally spaced around the periphery as illustrated in FIG. 2. It incorporates five bores for creating coaxial transmission line subassemblies but any number may be provided to meet the demands of a user.

Figure 3:
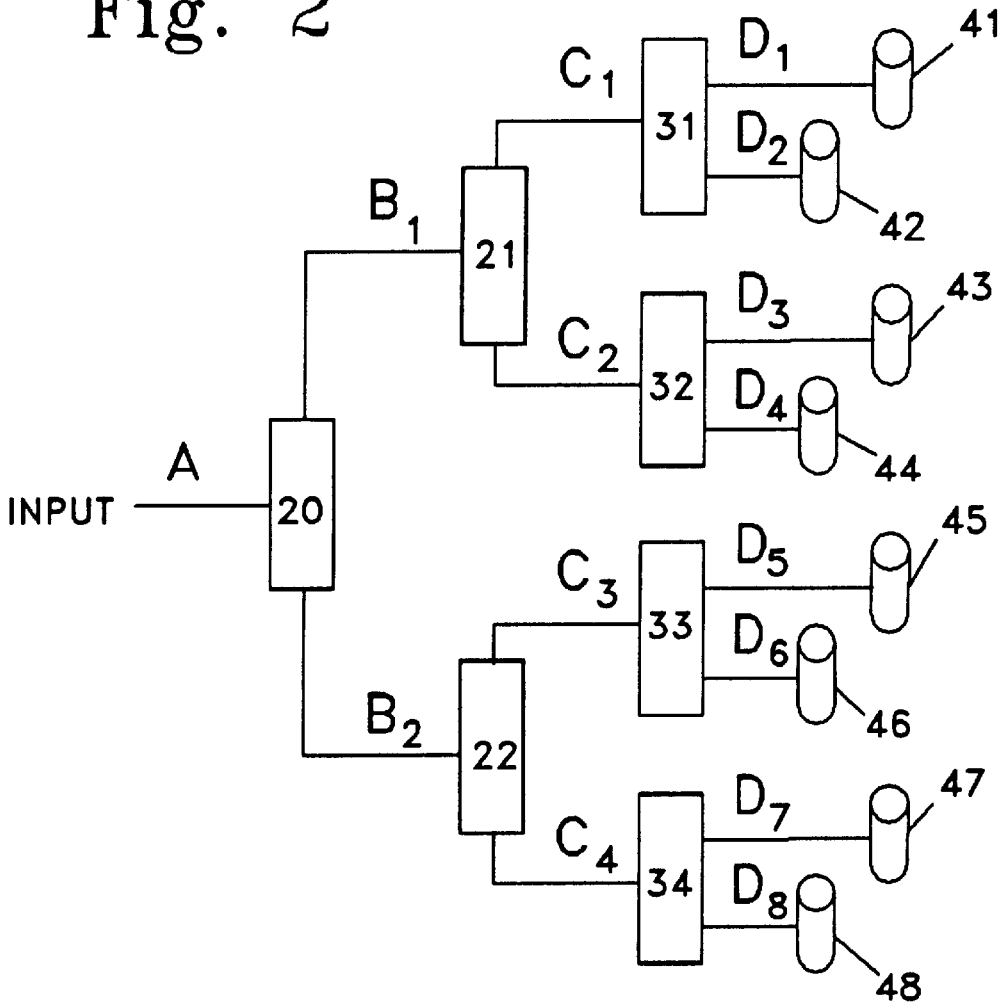
FIG. 3 is a simplified schematic diagram illustrating the application of a preferred form of the present invention to support an eight element linear array.

This configuration has the capability of supporting and being an electrically integral part of a single radiating element or an array of up to 16 radiating elements. A preferred form of the invention embodies an eight radiating element array such as schematically illustrated by FIG. 3. The extrusion illustrated in FIG. 1 has the capability of supporting two such arrays.

In FIG. 3, each interconnecting line represents a coaxial transmission line. The letter adjacent to the line indicates the bore, A, B, C, D or E, of the extrusion 10 of FIG. 2 which is used to form the coaxial line and the subscript number following indicates additional transmission lines formed in different sections of a common bore.

In a typical example of the use of the mast/transmission means, the input is by way of a coaxial transmission line utilizing bore A. A power divider 20 is placed adjacent to bore A at the center point of the array. The two outputs of power divider 20 feed individual coaxial transmission lines $B_1$ and $B_2$ in bore B. These transmission lines travel in opposite directions from the power divider 20 and are each terminated with a power divider 21 and 22 respectively.

The outputs of power dividers 21 and 22 are coupled to independent coaxial transmission lines in bore C travelling away from their power divider sources in opposite directions. The four bore C coaxial transmission lines are each terminated in a power divider, 31 through 34. These power dividers feed independent transmission lines $D_1$ through $D_8$ located in bore D. Each of these transmission lines provide a final feed for an individual radiating element, 41 through 48.

The above described configuration is schematically illustrated by FIG. 3 utilizes four of the five available bores in the antenna mast extrusion. Therefore, a second eight element array may be created on the mast using bore E of FIG. 2 as the primary input source and the repeat use of the additional bores shifted accordingly.

While preferred embodiments of this invention have been illustrated and described, variations and modifications may be apparent to those skilled in the art. Therefore, I do not wish to be limited thereto and ask that the scope and breadth of this invention be determined from the claims which follow rather than the above description.

What is claimed is:

1. An antenna mast, comprising:

an electrically conductive mast incorporating a longitudinal bore having a slot through a wall of said mast;

conductor positioned within said longitudinal bore for creating a coaxial transmission line and insulating means for holding said conductor in the center of said longitudinal bore.

2. An antenna mast as defined by claim 1 wherein said electrically conductive mast is an extrusion.

3. An antenna mast, comprising:

an electrically conductive mast incorporating a plurality of longitudinal bores;

said bores each having a slot through a wall of said mast;

conductors positioned within said longitudinal bores; and insulating means for holding said conductors in the center of said longitudinal bores for creating coaxial transmission lines having impedances established by said conductors.

4. An antenna mast as defined by claim 3 wherein selected ones of said coaxial transmission lines share selected ones of said longitudinal bores, comprising:

signal splitting means for interconnecting said coaxial transmission lines occupying different ones of said bores for providing a corporate feed structure for an antenna array.

5. An antenna mast as defined by claim 3, comprising:

dielectric loading means applied to predetermined ones of said coaxial transmission lines for creating a phase shift between elements of an antenna array supported by said mast.

6. An antenna mast as defined by claim 3, wherein said coaxial transmission lines are provided in predetermined lengths for creating phase shifts between elements of an antenna array placed at varying predetermined distances along said antenna mast.

7. An antenna mast as defined by claim 3, comprising:

longitudinal slots extending radially from said longitudinal bores for providing access to the interior of said longitudinal bores.

8. A ridged coaxial transmission line assembly, comprising:

an extrusion incorporating a plurality of longitudinal bores;

said bores each having a slot through a wall of said extrusion;

a conductor centrally located within at least one of said bores; and insulating means for holding said conductor centrally within said bore for creating a coaxial transmission line.

9. A ridged coaxial transmission line assembly as defined by claim 8 wherein properties of said conductor dictate the impedance of said coaxial transmission line.

10. A ridged coaxial transmission line assembly as defined by claim 9 wherein said bores are parallel.

* * * * *